United States Patent [19]

Beck

[11] Patent Number: 4,793,502

[45] Date of Patent: Dec. 27, 1988

[54] HINGED DISPENSING CLOSURE

[75] Inventor: James M. Beck, Carol Stream, Ill.

[73] Assignee: Creative Packaging Corp., Wheeling, Ill.

[21] Appl. No.: 162,066

[22] Filed: Feb. 29, 1988

[51] Int. Cl.[4] ..... B65D 43/14

[52] U.S. Cl. ..... 215/235; 220/339; 222/517

[58] Field of Search ..... 215/235, 237; 220/335, 220/339; 222/498, 517; 16/225, 227

[56] References Cited

U.S. PATENT DOCUMENTS

| | | | |
|---|---|---|---|
| 3,628,215 | 12/1971 | Everberg | 16/150 |
| 3,720,979 | 3/1973 | Krawagna | 16/150 |
| 4,047,495 | 9/1977 | O'Brian | 215/224 |
| 4,386,714 | 6/1983 | Robert et al. | 220/339 |
| 4,403,712 | 9/1983 | Wiesinger | 220/339 |
| 4,414,705 | 11/1983 | Ostrowsky | 220/339 X |
| 4,487,324 | 12/1984 | Ostrowsky | 215/235 X |
| 4,545,495 | 10/1985 | Kinsley | 215/235 |
| 4,573,600 | 3/1986 | Dubach | 215/237 |
| 4,638,916 | 1/1987 | Beck et al. | 215/235 |

FOREIGN PATENT DOCUMENTS 1056999 12/1964 United Kingdom .

*Primary Examiner*—Donald F. Norton

*Attorney, Agent, or Firm*—Silverman, Cass, Singer & Winburn, Ltd.

[57] ABSTRACT

A snap open hinged dispensing closure for a dispensing container. The closure having the snap open feature such that the closure lid is retained in an open position away from the dispensing opening of the container. The closure lid has a pair of hinges and a central tapered hinge strap formed therebetween.

16 Claims, 2 Drawing Sheets

FIG. 1
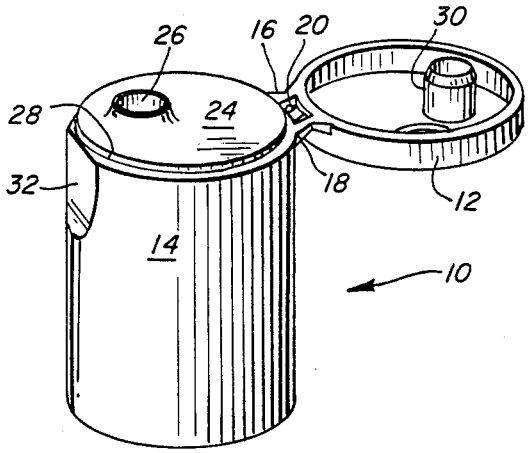
FIG. 2
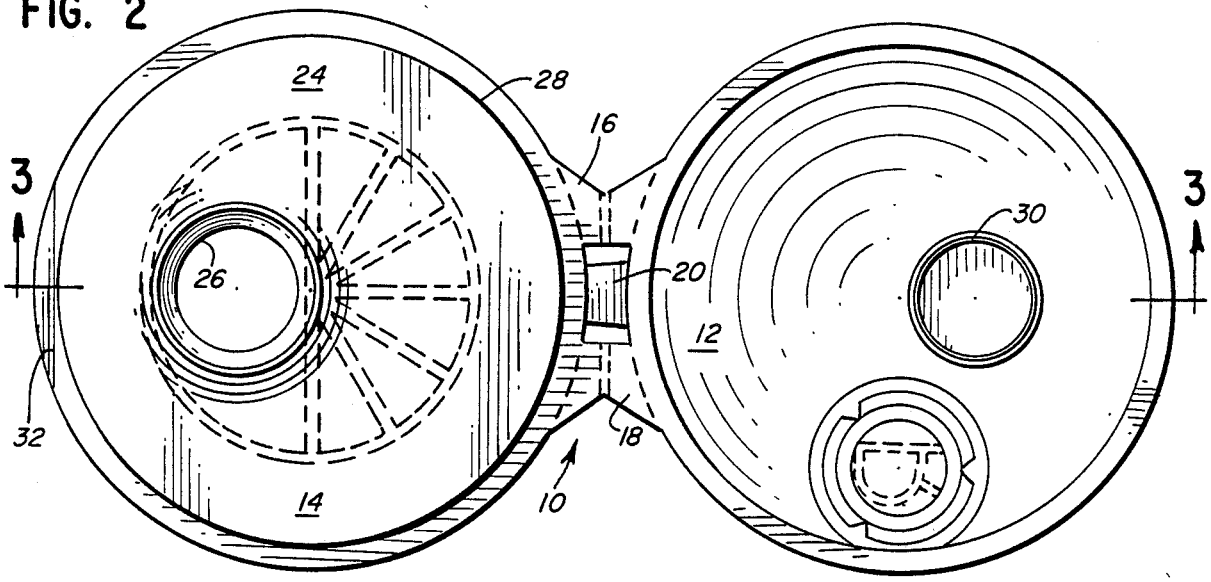
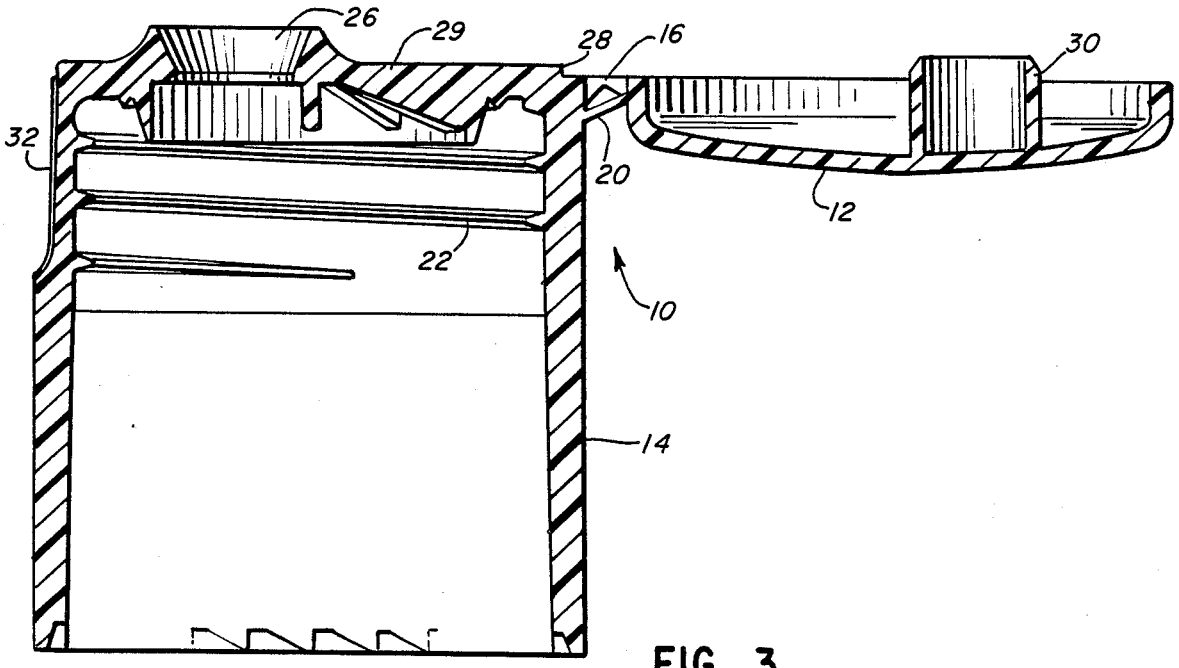
FIG. 3

FIG. 4
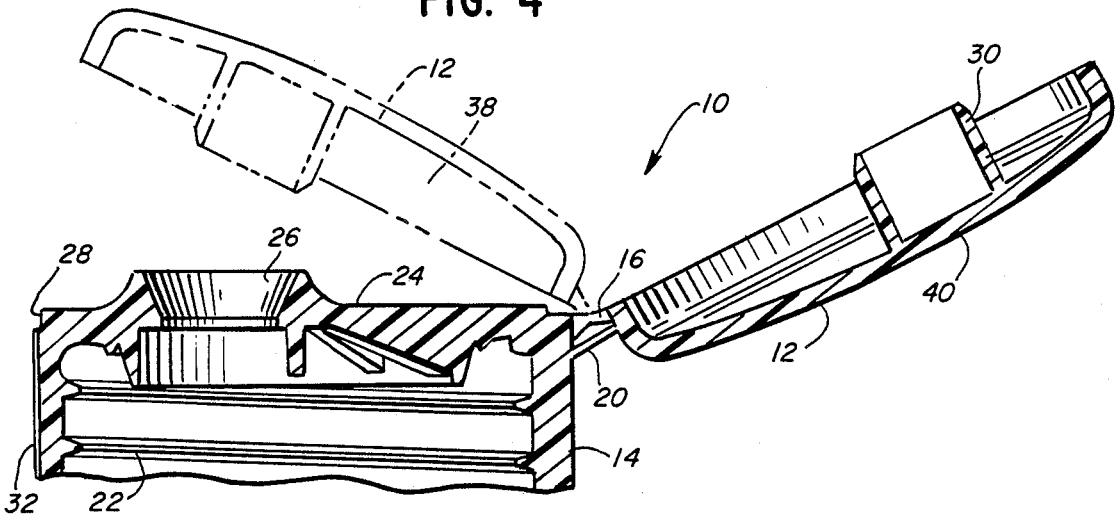
FIG. 5
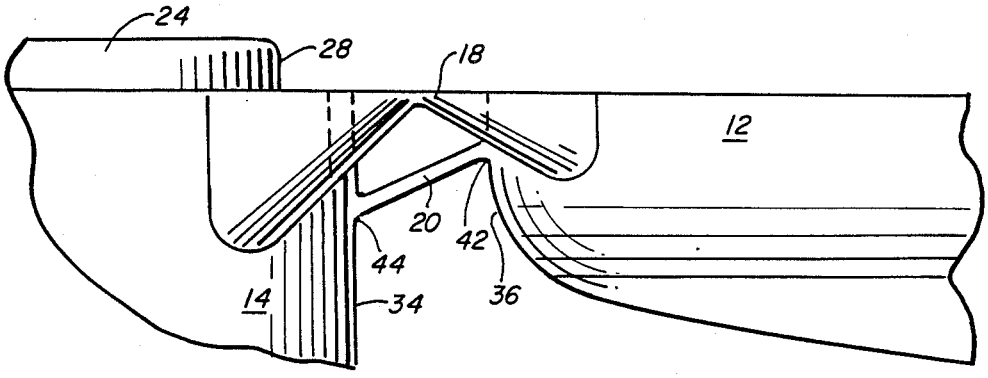
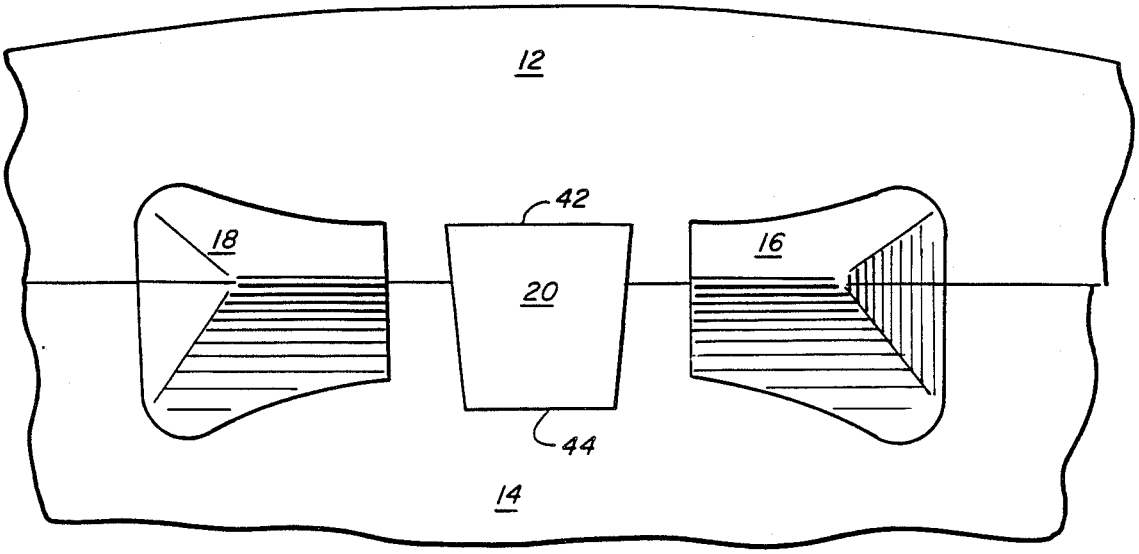
FIG. 6

HINGED DISPENSING CLOSURE

BACKGROUND OF THE INVENTION

The invention relates generally to a hinged dispensing closure for a dispensing container and more particularly to a snap open type closure lid which snaps open and holds the closure lid away from the dispensing opening.

Dispensing containers frequently have one of two types of closures. Originally dispensing closures primarily utilized closures employing spouts mounted so as to be capable of being moved between open and closed positions. A second type of closure has a pivotally mounted lid capable of being moved between a closed and an open dispensing position. In the closed position, the lid covers the dispensing opening and in the open position, the lid is moved away from the opening to allow the product in the container to be dispensed.

A particularly useful type of pivotally mounted lid includes a mechanism to maintain the lid in the closed or open position without an outside retaining or restraining force. The lid generally is secured in the closed position, such as by a friction type fit onto the closure and is maintained in the open position away from the dispensing opening by a second mechanism, such as a snap open type hinge.

It would be desirable to provide a closure with a snap open type lid or cap which is integrally formed with the closure and is formed with a minimum of parts and having a non-complex structure and a positive snap action.

SUMMARY OF THE INVENTION

The above and other disadvantages of prior art dispensing closures are overcome in accordance with the present invention by providing a snap open hinged dispensing closure. The closure has a hinged lid which is retained in the open position by the snap open structure. The snap open structure includes a pair of hinges and a central tapered hinge strap integrally formed with the closure and lid between the hinges.

BRIEF DESCRIPTION OF THE DRAWINGS

FIG. 1 is a perspective view of one embodiment of a hinged dispensing closure of the invention;

FIG. 2 is a top plan view of the closure of FIG. 1;

FIG. 3 is a side sectional view of the closure of FIG. 2 taken along the line 3—3 thereof;

FIG. 4 is a side sectional view of the closure similar to FIG. 3 illustrating the snap open operation of the closure;

FIG. 5 is a partial side view of the closure of the invention as molded; and

FIG. 6 is a rear side plan view of the closure of the invention in a fully closed position.

DESCRIPTION OF THE PREFERRED EMBODIMENTS

Referring to FIGS. 1–3, one embodiment of a hinged dispensing closure of the invention is designated generally by the reference numeral 10. The closure 10 includes a hinged lid 12 and a cap body 14, preferably formed in one piece, such as by molding, from a strong resilient plastic, such as polypropylene. The lid 12 includes a pair of hinges 16, 18 and a central tapered hinge strap 20 therebetween to provide the snap open feature and which will be further described with respect to FIGS. 4–6.

As best illustrated in FIG. 3, the cap body 14 includes inner threads 22 to allow the closure 10 to be secured to a dispensing container (not illustrated). The body 14 includes an upper wall or top 24 which includes a dispensing opening 26 therethrough. FIGS. 1–3 illustrate the closure in the open, just molded position. In the closed position, the lid 12 snaps shut over a peripheral edge 28 of the top 24. The lid 12 includes a plugging structure 30 which depends from the inside thereof to mate with the inside of the opening 26 to close the opening when the lid 12 is closed. The body 14 also includes a partial facet 32 along an edge opposite the hinges 16, 18 to allow the lid 12 easily to be opened.

Referring now to FIGS. 4–6, the operation of the closure 10 and the construction of the hinges 16 and 18 and the hinge strap 20 are best illustrated. When the closure 10 is first formed, the body 14 and the lid 12 are aligned with the lid substantially parallel with the top 24 of the body 14, as illustrated in FIG. 5 (and in FIGS. 1–3). The hinge strap 20 is formed attached at an angle to a side wall 34 of the body 14 and to a side wall 36 of the lid 12. The angle can be reversed if desired. When the closure 10 is utilized, the hinge strap 20 is slightly stretched, resulting in two open positions, as illustrated in FIG. 4.

The lid 12 when closed, snap fits over the edge 28, in a conventional manner which is not illustrated. When the lid 12 is pushed or pried open by exerting a force on the lid 12 at the top of the facet 32, the lid 12 assumes a first open position 38, illustrated in phantom. Clearly, the dispensing opening 26 is still somewhat blocked by the lid 12 in this first open position. By exerting a force to move the lid 12 substantially to or slightly beyond a perpendicular angle with the top 24, the hinge strap 20 causes the lid 12 to snap open into a second fully open position 40. The lid 12 is retained in this position by the action of the hinge strap 20 until it is desired to close the lid 12 in which case the opposite operation is performed to snap the lid 12 shut onto the top 24 of the body 14, as illustrated in FIG. 6.

The formation of the hinge strap 20 is crucial to the proper snap open operation of the closure 10. The closure 10 first was designed with the hinge strap formed parallel to the top 24 of the body 14 (perpendicular to the side walls 34 and 36), but this structure did not provide sufficient length for the hinge strap 20 to provide a proper snap action. The hinge strap 20 also could snap, making the closure 10 inoperative. The closure 10 preferably is operable for a large number of operations of opening and closing the lid 12, hence the operating life of the hinge strap 20 is critical.

The hinge strap 20 (best illustrated in FIG. 6) is formed with a tapered body having a first side 42 with a width wider than a second side 44. The side 44 is shown attached to the side wall 34, but the taper can be reversed with the wider side 42 attached to the side wall 34. The taper can be at an angle of about 15% from a parallel sided strap. The hinge strap 20 in one specific embodiment has a width at the side 42 of 0.200 inches with the width of the hinge connections of the hinges 16 and 18 being about 0.035 inches. The hinge strap 20 has a thickness on the order of 0.006 to 0.011 inches. In this example, the closure 10 has a diameter of 1.070 inches.

The hinge strap 20 and the hinges 16 and 18 thus formed provide a non-complex snap open hinge structure, which also has a long operating life. The relative dimensions, of course, would be changed to accommodate different sized closure. The length of the hinge strap 20 varies with the specific application with the angle of the strap 20 and the distance below the top edge of the lid 12 and hinges 16, 18 varied to obtain the desired snap action.

Modifications and variations of the present invention are possible in light of the above teachings. It is therefore to be understood that within the scope of the appended claims, the invention may be practiced otherwise than as specifically described.

What is claimed and desired to be secured by Letters Patent of the United States is:

1. A closure with a snap type hinge cap, comprising:

a cap body portion adapted to be secured to a container;

a lid hinged to said cap body by a pair of spaced apart hinges integrally formed between said cap body and said lid; and a substantially planar tapered hinge strap integrally formed between said cap body and said lid between said pair of hinges, said hinge strap having a width at one end adjacent one of said cap body and said lid greater than the width at a second end thereof.

2. The closure as defined in claim 1 wherein said tapered hinge strap has a width on a side attached to said cap body greater than the width attached to said lid.

3. The closure as defined in claim 1 wherein said tapered hinged strap has a width on a side attached to said lid greater than the width attached to said cap body.

4. The closure as defined in claim 1 wherein said hinge strap is attached at an angle to said cap body and to said lid.

5. The closure as defined in claim 4 wherein said cap body has an upper free edge and said lid has an upper free edge and said hinges have an upper edge formed substantially aligned with said lid and said cap body free edges.

6. The closure as defined in claim 5 wherein said cap body and said lid have side walls opposed to one another and said hinge strap is attached to said cap body and to said lid on said side walls below said free edges.

7. The closure as defined in claim 6 wherein said hinge strap is attached to said cap body side wall at a greater distance from said free edges that said hinge strap is attached to said lid side wall.

8. The closure as defined in claim 6 wherein said hinge strap is attached to said lid side wall at a greater distance from said free edges than said hinge strap is attached to said cap body side wall.

9. The closure as defined in claim 1 wherein said hinge strap is formed from polypropylene and has a thickness on the order of 0.006 to 0.011 inches.

10. A closure with a snap type hinge cap, comprising:

a cap body portion adapted to be secured to a container;

a lid hinged to said cap body by a pair of spaced apart hinges integrally formed between said cap body and said lid;

said cap body having an upper free edge and said lid having an upper free edge and said hinges having an upper edge formed substantially aligned with said lid and said cap body free edges; and a substantially planar tapered hinge strap integrally formed between said cap body and said lid between said pair of hinges, said hinge strap being attached at an angle to said cap body and to said lid, said hinge strap having a width at one end adjacent one of said cap body and said lid greater than the width at a second end thereof.

11. The closure as defined in claim 10 wherein said tapered hinge strap has a width on a side attached to said cap body greater than the width attached to said lid.

12. The closure as defined in claim 10 wherein said tapered hinge strap has a width on a side attached to said lid greater than the width attached to said cap body.

13. The closure as defined in claim 10 wherein said cap body and said lid have side walls opposed to one another and said hinge strap is attached to said cap body and to said lid on said side walls below said free edges.

14. The closure as defined in claim 13 wherein said hinge strap is attached to said cap body side wall at a greater distance from said free edges than said hinge strap is attached to said lid side wall.

15. The closure as defined in claim 13 wherein said hinge strap is attached to said lid side wall at a greater distance from said free edges than said hinge strap is attached to said cap body side wall.

16. The closure as defined in claim 10 wherein said hinge strap is formed from polypropylene and has a thickness on the order of 0.006 to 0.011 inches.

* * * * *